United States Patent [19]

Goedert

[11] 4,392,887

[45] Jul. 12, 1983

[54] METHOD OF DESULFURIZING AN IRON MELT

[75] Inventor: Jean Goedert, Luxembourg, Luxembourg

[73] Assignee: Arbed S.A., Luxembourg, Luxembourg

[21] Appl. No.: 327,450

[22] Filed: Dec. 4, 1981

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,575,695 | 4/1971 | Miyashuta | 75/58 |
| 3,885,957 | 5/1975 | Richter | 75/58 |
| 3,998,625 | 12/1976 | Koros | 75/53 |
| 4,036,635 | 7/1977 | Klapdar | 75/58 |
| 4,040,818 | 8/1977 | Clegg | 75/53 |
| 4,066,444 | 1/1978 | Kosmider | 75/58 |

*Primary Examiner*—P. D. Rosenberg

*Attorney, Agent, or Firm*—Karl F. Ross; Herbert Dubno

[57] ABSTRACT

A desulfurization method in which an iron melt, carefully skimmed from slag in a ladle, is covered with about 1 to 2 kg. of lime per ton of iron, the melt is deoxidized to at most 35 ppm of oxygen and is then blown with a mixture of lime, calcium fluoride and metallic aluminum in an inert gas by means of a lance immersed in the bath so that the outlet of the lance is at an average depth of about 1500 mm below the bath surface.

6 Claims, 1 Drawing Figure

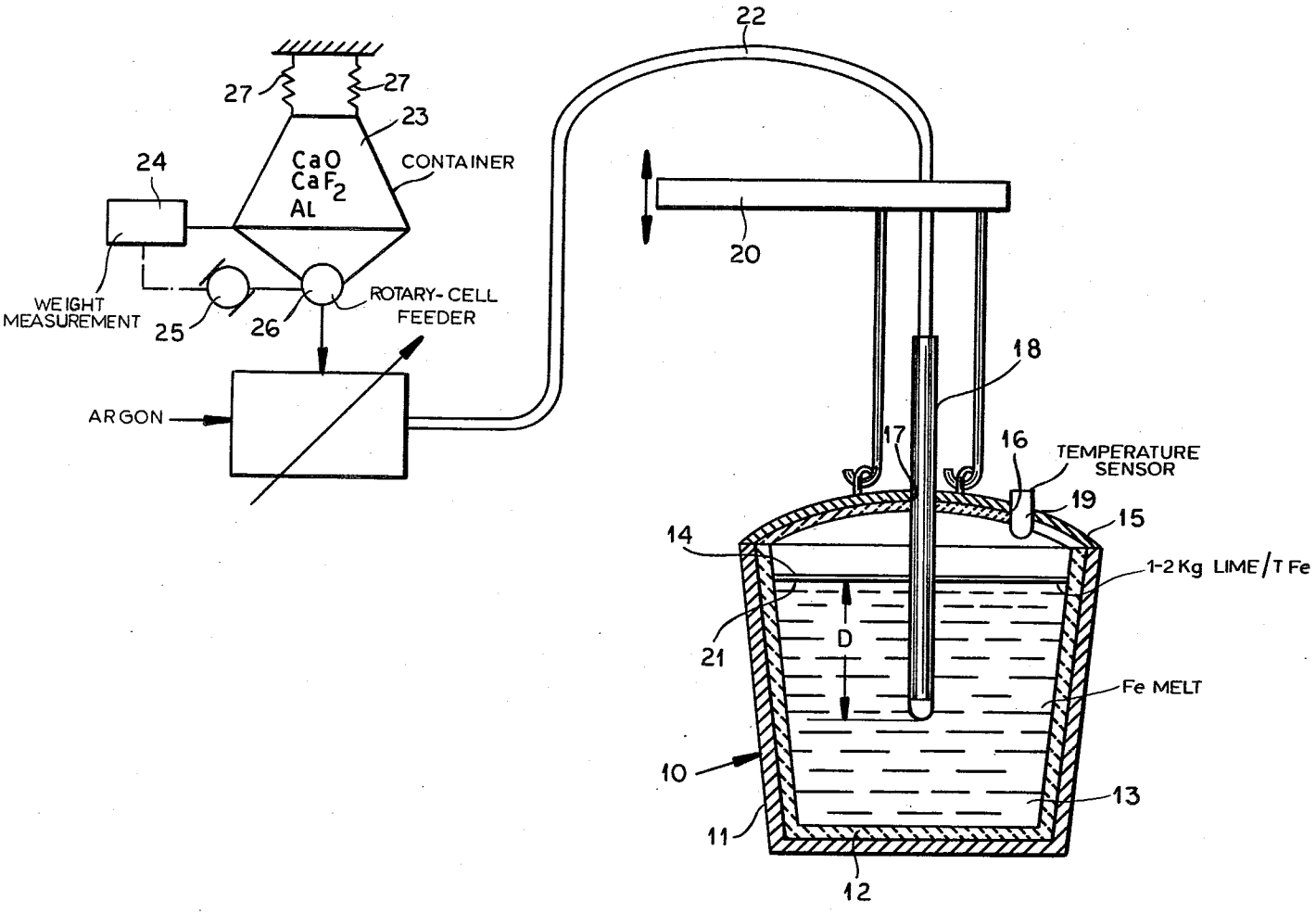
1-2 Kg LIME/T Fe
Fe MELT
TEMPERATURE SENSOR
D
CONTAINER
CaO
CaF2
AL
ROTARY-CELL FEEDER
WEIGHT MEASUREMENT
ARGON
10
11
12
13
14
15
16
17
18
19
20
21
22
23
24
25
26
27
27

METHOD OF DESULFURIZING AN IRON MELT

FIELD OF THE INVENTION

The present invention relates to a method of desulfurizing an iron melt and, more particularly, to a desulfurization method in which desulfurizing agents are introduced into the melt in a ladle by so-called immersion lances, i.e. a lance which is introduced through the top of the melt and opens at a point below the melt surface.

BACKGROUND OF THE INVENTION

The desulfurization of iron or steel melts, i.e. ferrous melts, has been of concern in the steel-making industry for some time and in the last decade or so, many systems have been described for effecting desulfurization.

Reference may be made to the following German patent publications:

22 09 902, 22 19 818, 23 12 137 and 25 27 156.

The following articles are also considered relevant:

*The Bofors Desulfurizing Process,* Steel Times, November 1970, pp. 805–808.

*Neues Stahlentschwefelungsverfahren,* Neue Hütte, 1b, Part 2, February 1971.

*Influence of Injection of Solid Particles in the Ladle on Sulphide and Oxide Cleanness of Steels,* Stahl und Eisen 99, pp. 1215–1217, No. 22, 5 November 1979.

The following U.S. patents, some of which are equivalent to the German patent publications mentioned, are also deemed to be relevant:

3,575,695,
4,067,730,
4,123,258,
3,885,957,
4,036,635,
3,891,196,
3,992,195,
3,807,602,
3,980,469.

It is known that desulfurization processes are of increasing effectiveness as the oxygen concentration in the melt is reduced. For this reason an iron melt is generally deoxidized before desulfurization and care is taken so that the slag which overlies the surface of the melt has a chemical composition such that there is minimum or reduced danger of reoxidation during the subsequent desulfurization.

Various processes have been developed with precisely these considerations in mind. For example, in the above mentioned German patent publication No. 22 09 902, desulfurization of the melt is carried out in a ladle lined with fire clay, magnesite, dolomite or a material with a high alumina content.

The melt is initially deoxidized, covered with a slag of predetermined chemical composition and then treated with a mixture of finely divided calcium or calcium compounds with a neutral carrier gas.

This mixture is introduced into the melt by an immersion lance opening below the surface of the melt and whereby the desulfurizing agents are blown in the latter.

The desulfurizing agents are primarily elemental calcium or calcium compounds such as CaO, $CaF_2$, CaSi and $CaC_2$. The carrier gas is a neutral gas such as argon.

The slag should have less than 2% iron oxide. The mouth of the lance should be more than about 2000 mm. below the surface of the iron melt and the prior deoxidation should be effected, in accordance with this reference, so that more than 0.015% aluminum remains in the metal phase.

Unless otherwise indicated herein, all percents are by weight.

These relationships imply others based upon the usual physical parameters. For example, the immersion depth of the lance should be at least 2 meters. In the specific example, a depth of 2.6 meters was used for a ladle having a height of 4 meters. Calcium has, at 1600° C., a vapor pressure of 2.13 atmospheres and thus will be in a liquid state in the melt as long as it is introduced at least 1.7 m below the surface. The liquid calcium droplets appear to rise more slowly than vapor bubbles of calcium would, thereby ensuring an increased reaction time and effective utilization of the calcium blown into the melt.

While this process has been found to be effective for the latter purpose, it nevertheless has certain disadvantages including the need for a synthetic slag which must be compounded at considerable cost and effort. It also requires constant monitoring of the slag composition.

OBJECTS OF THE INVENTION

It is the principal object of the present invention to provide a process for the desulfurization of an iron melt whereby the latter disadvantages are obviated, i.e. it is not necessary to produce a synthetic slag for effective desulfurization.

Another object of this invention is to provide an improved desulfurization process which can more effectively and efficiently desulfurize a steel melt, preferably in a ladle utilizing the immersion-lance technique.

SUMMARY OF THE INVENTION

These objects and others which will become apparent hereinafter are attained, in accordance with the present invention, in a method which is based upon the surprising discovery that a synthetic slag is not required on top of the melt provided that the melt is covered with lime and the blowing of the desulfurization agent into the melt is effected with some differences from the techniques utilized heretofore.

More particularly, according to the invention, the iron melt is introduced into an appropriate ladle, carefully skimmed from slag and covered with about 1 to 2 kg. of lime per metric ton of iron. The melt is then deoxidized to an oxygen concentration of at most 35 parts per million (ppm) and is thereafter desulfurized by an immersion lance being located at an average depth of about 1500 mm below the surface of the bath.

As can be gathered from the foregoing, it is especially important that the slag of the melt which is introduced into the ladle be removed as fully as possible.

This can be accomplished during the tapping of the melt from the furnace into the ladle, utilizing any conventional techniques to be certain that the slag, prior to and at the end of the tapping of the charge, be retained in the furnace to the greatest possible extent. This can be accomplished by utilizing a hollow plug and ball at the tap hole of the furnace.

The slag which manages to pass into the ladle is then skimmed before the bath is covered with 1 to 2 kg. of calcium oxide per metric ton of iron of the melt.

The retention of the furnace slag at the beginning and termination of the tapping operation is preferably effected by the technique described in the Luxembourg patent application 6 1.204 and the means described in it.

It is important that the slag be removed to the greatest possible extent so that the surface of the bath which is covered with the lime should be substantially free from the furnace slag.

It may be observed that in the absence of the slag, the bath surface would have an increased tendency to take up nitrogen and hydrogen from the atmosphere and this tendency is eliminated or reduced by the application of pure lime as a covering for the bath. The lime, therefore, has the dual purposes of protecting the bath from the incursion of nitrogen and hydrogen and of improving the desired metallurgical reactions which appear to be promoted at the boundary layer formed between the lime and the melt.

It has been found to be advantageous, moreover, to cover the ladle after application of the layer of lime to the melt thereby providing further protection against the uptake of nitrogen and hydrogen. The only opening required in the cover, therefore, can be an opening through which the lance passes. It is also advantageous in some cases to provide a temperature detector which can respond to the melt temperature and the latter can also pass through an opening in the cover. The temperature detector senses the temperature of the melt and, accordingly, the oxygen activity thereof.

The desulfurization agent is, as noted, a mixture of lime, calcium fluoride and aluminum. The solids component can consist of up to 30 weight percent of aluminum, up to 20 weight percent of calcium fluoride and from 50 to 100 weight percent of lime, although it is preferred that at least 1% each of calcium fluoride and aluminum be contained therein.

The proportion of aluminum utilized will of course depend on the measured oxygen activity in the melt.

In spite of covering of the ladle and covering of the melt with lime, the blowing of the melt will result in some agitation of the bath surface and hence possible incorporation of atmospheric oxygen from above the melt into the latter. Accordingly, the aluminum content of the mixture can be increased to compensate for the additional oxygen uptake and maintain the oxygen concentration in the melt at the maximum indicated.

BRIEF DESCRIPTION OF THE DRAWING

The above and other objects, features and advantages will become more readily apparent from the following description, reference being made to the accompanying drawing, the sole FIGURE of which is a diagram of an apparatus for carrying out the method of the invention.

SPECIFIC DESCRIPTION

In the drawing there is shown a conventional ladle 10 whose outer casing 11 is formed with a lining 12. The ladle receives the iron melt 13 which is covered, after having been carefully deslagged, with a layer 14 of lime in the manner described. The ladle is provided with a cover 15 which can have openings 16 and 17 only for an immersion lance 18 and a temperature sensor 19, the latter providing a measure of temperature from which the oxygen content of the melt can be ascertained. The cover and the lance 18 are supported by the usual mechanism or frame 20, represented only diagrammatically, for lowering the lance into the ladle, the outlet of the lance lying at a depth D about 1500 mm below the surface 21 of the melt. The mixture of aluminum, lime and calcium fluoride, entrained by argon, is formed at 26 by a variable rate feeder and delivered by a flexible pipe 22 to the lance.

Surprisingly it has been found that the individual components of this mixture do not have to be comminuted to an extremely fine particle size and indeed the system is operative with particles of a particle size ranged up to 2 mm. Another surprising factor is that the immersion depth of the lance can be less than that which would have been expected from the teachings of the art and indeed not only are effective results obtained at about 1500 mm but the best results are obtained at about this immersion.

It has been found to be advantageous, moreover, to feed the carrier gas at a constant rate through the lance and to vary the quantity of the mixture and the composition in accordance with the requirements per unit time.

Depending upon the temperature of the melt, the mixture can be fed at a substantially constant rate over the entire treatment area or a predominant portion can be supplied during an initial period with a reduced quantity spread over the remainder of the treatment.

It is, of course, possible in accordance with another feature of the invention to maintain the rate of feed of the mixture, i.e. the quantity per unit time, constant and to vary the rate at which the carrier gas is supplied when, for example, at different times stronger or weaker turbulence is desired in the melt.

The freedom of selection of the desulfurization treatment conditions, limited only as prescribed above, is another advantage of the instant invention since the device 26 can be a cell wheel metering device provided with a gas gate and enabling stepless control of the rate of feed of the mixture and of the gas. In this case, the rate of feed of the mixture is determined solely by the rate at which the cell wheel rotates and this can readily be varied by controlling the speed of an electric motor driving it. The carrier gas flow can be independently varied.

When for example feed of the mixture at a constant rate is desired, this can easily be accomplished by measuring the rate of weight loss of the mixture container and controlling the difference accordingly. Such control devices are conventionally available and need not be described in detail.

Finally, it can be noted that one of the advantages of this invention is that extremely low sulfur contents can be obtained in an efficient and economical manner and further that the proportion of inclusions in the product is low and any inclusions which are present have a spheritic character.

The container is shown at 23 in the drawing to be suspended by springs 27 which allows a position detector 24 to respond to the change of weight and control the motor 25 of the rotary cell feeder 26 as previously described.

I claim:

1. A method of desulfurizing an iron melt comprising the steps of:

(a) forming a bath in a ladle having an upper surface free from slag;

(b) covering said surface with 1 to 2 kg. of lime per ton of melt;

(c) covering said ladle;

(d) independently of the covering of said surface with lime, deoxidizing said melt to a maximum oxygen concentration of about 35 parts per million; and (e) independently of the covering of said surface with lime, blowing a desulfurizing mixture with an inert gas through an immersion lance into said melt at an average depth of about 1500 mm below said surface, said mixture consisting substantially of 50 to 98% lime, at least 1% Al up to 30% aluminum and at least 1% $CaF_2$ up to 20% calcium fluoride.

2. The method defined in claim 1, further comprising the step of tapping said melt into said ladle from a furnace and retaining furnace slag in said furnace at the beginning and end of the tapping, any slag entrained by said melt being skimmed from said bath in said ladle.

3. The method defined in claim 1, or claim 2 wherein said mixture contains solids in a particle size up to 2 mm.

4. The method defined in claim 1, or claim 2 wherein during step (e) the inner gas flow through the lance is maintained constant and the quantity of solids in said mixture is steplessly varied.

5. The method defined in claim 1, or claim 2, further comprising the step of varying the inner gas flow through this lance during the treatment in step (e).

6. The method defined in claim 1, or claim 2 wherein the solids in said mixtures are delivered to said lance in response to continuous measurement of decreasing weight in said container.

* * * * *